US012037755B2

(12) United States Patent
Abresch et al.

(10) Patent No.: US 12,037,755 B2
(45) Date of Patent: Jul. 16, 2024

(54) DUAL DRIVE MILLING ATTACHMENT

(71) Applicant: Wirtgen GmbH, Windhagen (DE)

(72) Inventors: Stefan Abresch, Dierdorf (DE); Marcel Joisten, Neuwied (DE)

(73) Assignee: Wirtgen GmbH (DE)

( * ) Notice: Subject to any disclaimer, the term of this patent is extended or adjusted under 35 U.S.C. 154(b) by 35 days.

(21) Appl. No.: 17/890,431

(22) Filed: Aug. 18, 2022

(65) Prior Publication Data

US 2024/0060249 A1 Feb. 22, 2024

(51) Int. Cl.
*E01C 23/088* (2006.01)
*E01C 23/12* (2006.01)

(52) U.S. Cl.
CPC ..... *E01C 23/088* (2013.01); *E01C 23/127* (2013.01)

(58) Field of Classification Search
CPC ..... E01C 23/088; E01C 23/127
See application file for complete search history.

(56) References Cited

U.S. PATENT DOCUMENTS

| | | | | |
|---|---|---|---|---|
| 4,536,636 | A | 8/1985 | Opprecht et al. | |
| 4,704,045 | A * | 11/1987 | Taylor | E01C 23/127 404/90 |
| 4,803,789 | A | 2/1989 | Hackmack | |
| 5,381,616 | A | 1/1995 | Disney | |
| 5,382,084 | A * | 1/1995 | Diver | E01C 23/088 299/39.5 |
| 6,116,699 | A | 9/2000 | Kaczmarski et al. | |
| 7,104,510 | B2 * | 9/2006 | Beller | E01C 23/088 248/62 |
| 7,665,806 | B2 | 2/2010 | Rotz et al. | |
| 8,002,360 | B2 | 8/2011 | Cochran et al. | |
| 9,127,417 | B2 | 9/2015 | Risi | |
| 10,358,793 | B2 | 7/2019 | Risi | |
| 10,443,209 | B2 | 10/2019 | Kumbhar et al. | |
| 11,313,087 | B2 | 4/2022 | Berning et al. | |
| 2005/0103947 | A1 | 5/2005 | Beller | |
| 2007/0116519 | A1 | 5/2007 | Haroldsen | |
| 2008/0246328 | A1 | 10/2008 | Mannebach et al. | |

(Continued)

FOREIGN PATENT DOCUMENTS

| | | |
|---|---|---|
| DE | 1206936 B | 12/1965 |
| DE | 9407487 U1 | 7/1994 |

(Continued)

OTHER PUBLICATIONS

Exhibit A—3 sheets of drawings of a dual drive milling attachment (undated but admitted to be prior art).

(Continued)

*Primary Examiner* — Janine M Kreck
(74) *Attorney, Agent, or Firm* — Lucian Wayne Beavers; Patterson Intellectual Property Law, PC

(57) ABSTRACT

A milling attachment for a work machine includes a frame including first and second frame side walls A motor mounting plate is removably mounted on the second frame side wall. A milling drum includes first and second mounting flanges. A first drive motor is mounted on the first frame side wall and includes a drive end connected to the first drum mounting flange by a plurality of threaded fasteners. A second drive motor is mounted on the motor mounting plate and connected to the second drum mounting flange by a stab-in non-threaded connector.

19 Claims, 11 Drawing Sheets

(56) References Cited

U.S. PATENT DOCUMENTS

| | | | |
|---|---|---|---|
| 2009/0232598 | A1 | 9/2009 | Cochran et al. |
| 2020/0407927 | A1 | 12/2020 | Berning et al. |

FOREIGN PATENT DOCUMENTS

| | | | |
|---|---|---|---|
| DE | 10105475 | C1 | 5/2002 |
| DE | 202010010857 | U1 | 11/2010 |
| EP | 681063 | A2 | 11/1995 |
| EP | 1222333 | A1 | 7/2002 |
| EP | 2495367 | B1 | 6/2015 |
| EP | 3350373 | B1 | 9/2021 |
| JP | 2001073318 | A | 3/2001 |
| JP | 2004285745 | A | 10/2004 |
| WO | 9105915 | A1 | 5/1991 |
| WO | 0116429 | A1 | 3/2001 |
| WO | 0125545 | A1 | 4/2001 |

OTHER PUBLICATIONS

Bobcat Parts Manual, cover and pp. 149-152, (2010) showing a dual drive milling attachment.

Corresponding co-pending U.S. Appl. No. 17/890,448, filed Aug. 18, 2022 (not prior art).

Corresponding co-pending U.S. Appl. No. 18/093,363, filed Jan. 5, 2023, (co-pending, not prior art).

Bobcat Standard Flow Planer, Operations & Maintenance Manual for s/n 231200101 & above, cover and pp. 14 & 18, (2000) showing Ski Height Adjustment, Cutting Concrete, Cutting Asphalt and Planing a General Area.

Bobcat Planer Wheel Saws, Parts Manual vol. 4 Attachments, cover and p. 185-186, & 188, (2010) showing part number for Housing Group 14" 231200101 & above.

Bradco Operator's and Parts Manual 16", 18", 24", 30" & 40" High Flow Cold Planers with 3-Function Control and Selector Valve For Skid Steer Loaders, Manual No. OM667, Part No. 75567, Rev. 6 (2010), 65 pages.

Bradco Operator's and Parts Manual HP400/HP450/HP600/H{750/HP1000 Cold Planers for Skid Steer Loaders, Manual No. OM666, Parts No. 75566, Rev. 3, 66 pages (undated but admitted to be prior art).

Bobcat Planers Wheel Saws vol. 4 Attachments Parts Manual, Main Frame Parts List, (2001) 8 pages.

Bradco Bulletin, John Deere Skid Steer Bulletin No. 07SS06, (2007) Product and Training Information Bulletin, 3 pages.

Bradco Operator's Manual CP12C, CP18C, CP24C and CP30C Cold Planers, OMT229749 Issue H9, 60 pages (undated but admitted to be prior art).

Roadhog Cold Planers Spec Sheet May 2020, 1 page.

Bobcat Planner Attachment, Features & Benefits, Product Overview, Compatible Models and Specifications, 4 pages (undated but admitted to be prior art).

Photo excerpted from https://www.youtube.com/watch?app=desktop&v=ZkjiOPulnyw Milling / Cold Planing Attachments—Schibeci Range Publication—Oct. 6, 2008.

Photos excerpted from https://www.youtube.com/watch?app=desktop&v=nTfewSk2Ne0 Bobcat Planer Attachment | Bobcat Equipment Publication—Mar. 10, 2010.

European Search Report for corresponding patent application No. 23191759.2, dated Jan. 22, 2024, 6 pages (not prior art).

* cited by examiner

DUAL DRIVE MILLING ATTACHMENT

FIELD OF THE DISCLOSURE

The present disclosure relates to a dual motor drive system for a milling attachment for a work machine. The milling attachment may be used to mill a ground surface.

BACKGROUND

The prior art includes milling attachments having dual drive motors. In such a system two separate hydraulic motors drive opposite ends of the milling drum of the milling attachment. In prior art designs both of the drive motors are connected to the milling drum by threaded connectors, thus requiring a complex mechanical arrangement to allow for the assembly and disassembly of the milling drum with the milling attachment and to allow for thermal expansion of the milling drum during milling operation.

There is a need for improved assembly arrangements allowing for faster and less labor intensive procedures for removing and replacing the milling drum of a milling attachment having dual drives.

SUMMARY OF THE DISCLOSURE

In one embodiment a milling attachment for a work machine includes a frame including first and second frame side walls A motor mounting plate is removably mounted on the second frame side wall. A milling drum includes first and second mounting flanges. A first drive motor is mounted on the first frame side wall and includes a drive end connected to the first drum mounting flange by a plurality of threaded fasteners. A second drive motor is mounted on the motor mounting plate and connected to the second drum mounting flange by a stab-in non-threaded connector.

The second drum mounting flange may include a central opening and a plurality of radially offset openings. The stab-in non-threaded connector may include a center hub mounted on the second drive motor and configured to be received in the central opening, and a plurality of radially offset pins configured to be received in the plurality of radially offset openings.

The plurality of radially offset pins may include at least three radially offset pins. The pins may be equally spaced circumferentially around the center hub.

In any of the above embodiments, the center hub may include a cylindrical outer bearing surface configured to be closely received in the central opening, and the center hub may include a tapered axial end configured to guide the cylindrical outer bearing surface into the central opening.

In any of the above embodiments, the center hub may include an inside diameter equal to at least 40% of an inside diameter of a drum casing of the milling drum to allow access through the center hub to a plurality of fasteners connecting the center hub to the second drive motor.

In any of the above embodiments, the center hub may have an open axial end to allow access through the center hub to a plurality of fasteners connecting the center hub to the second drive motor.

In any of the above embodiments, the stab-in non-threaded connector may include a base plate having a generally circular mid-portion with three protruding lobes, and the plurality of radially offset pins may include three radially offset pins one of which is mounted on each of the lobes.

In any of the above embodiments, the central opening of the second drum mounting flange may have a diameter equal to at least 40% of an inside diameter of a drum casing of the milling drum to allow access to the fasteners connecting the first drive motor to the first drum mounting flange.

In any of the above embodiments, the first and second drive motors may be hydraulic motors.

In any of the above embodiments, the first and second hydraulic motors may be completely received between the first frame side wall and the motor mounting plate.

In any of the above embodiments, the milling attachment frame may include a back plate configured to be mounted on the work machine.

In another embodiment a method of removing a milling drum from a milling attachment of a work machine, may include steps of:

(a) removing the motor mounting plate and the second drive motor by removing a plurality of threaded fasteners to disconnect the motor mounting plate from the second frame side wall and withdrawing the stab-in non-threaded connector from the second drum mounting flange;

(b) disconnecting the first drive motor from the first drum mounting flange by removing another plurality of threaded fasteners; and (c) removing the milling drum from the frame.

In the above method the motors may be hydraulic motors, and the method may be performed without disconnecting any hydraulic hoses from the hydraulic motors.

Numerous objects, features and advantages of the present invention will be readily apparent to those skilled in the art upon a review of following description in conjunction with the accompanying drawings.

DETAILED DESCRIPTION

Figure 1:
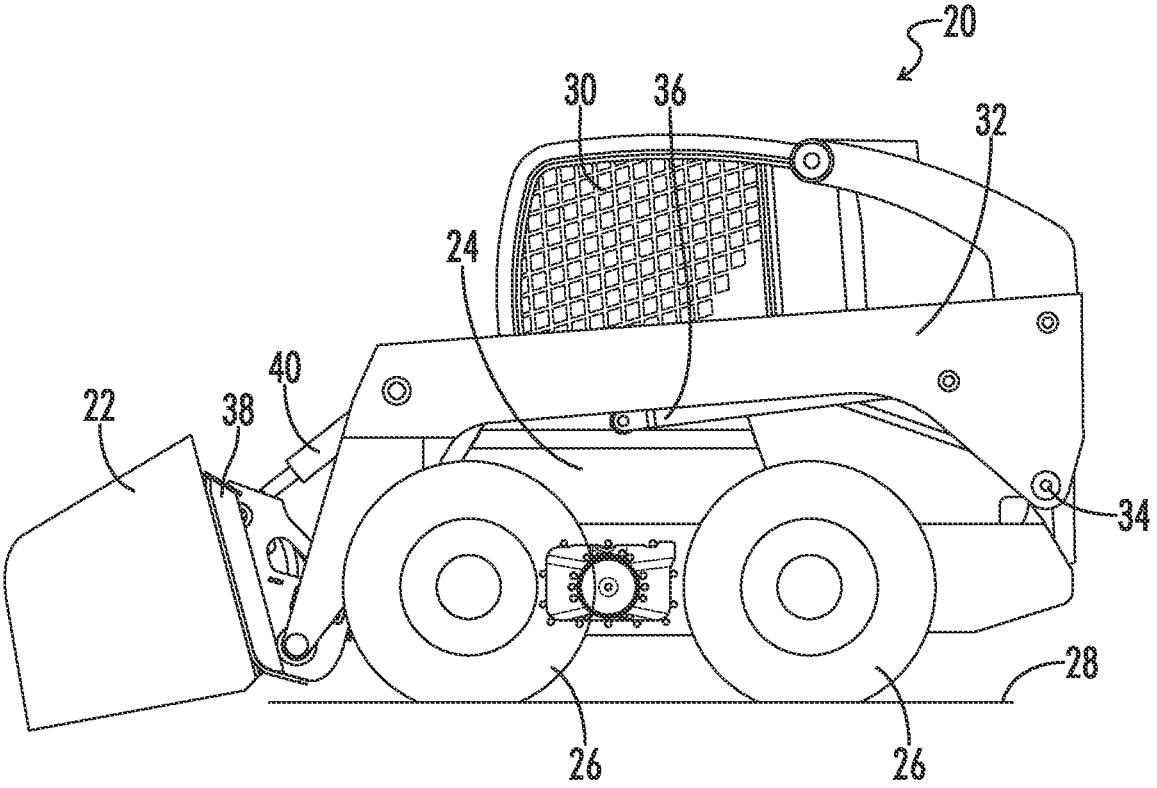
FIG. 1 is a left side elevation view of a work machine and schematically shows a milling attachment mounted on the work machine.

Referring now to the drawings FIG. 1 shows a left side elevation view of a work machine 20 carrying a milling attachment 22. As used in the following description the terms "left" and "right" are from the viewpoint of an operator of the work machine sitting in the operator's station 30 and facing forward. The work machine 20 is shown as a skid steer loader, such as for example a John Deere model 320G loader. The work machine 20 may also take other forms, such as for example an excavator such as a John Deere model 130G excavator. Milling attachments of this type are used on such work machines to mill a ground surface to remove a portion of the ground surface. The ground surface is often a paved surface made of asphalt or concrete. The milling may be a preface to a repaving of the ground surface.

The work machine 20 may include a machine frame 24 supported from a ground surface 28 by a plurality of ground engaging units 26 so that the work machine 20 is a self-propelled work machine. The ground engaging units 26 are shown as wheels but tracked ground engaging units may also be used. An operator's station 30 is carried on the machine frame 24. A boom 32 is pivotally connected to the machine frame 24 at 34 and can be raised and lowered relative to the machine frame 24 by lift cylinders such as 36. The boom 32 carries an attachment mounting frame 38 which may also be referred to as a manipulation frame 38. An implement actuator cylinder 40 can pivot the attachment mounting frame 38 relative to the boom 32. It will be understood that the attachment mounting frame 38 is a standard part of a work machine that is designed to allow various tool attachments to be mounted on the work machine 20 and manipulated relative to the machine frame 24 by operation of the actuators 36 and 40.

Figure 2:
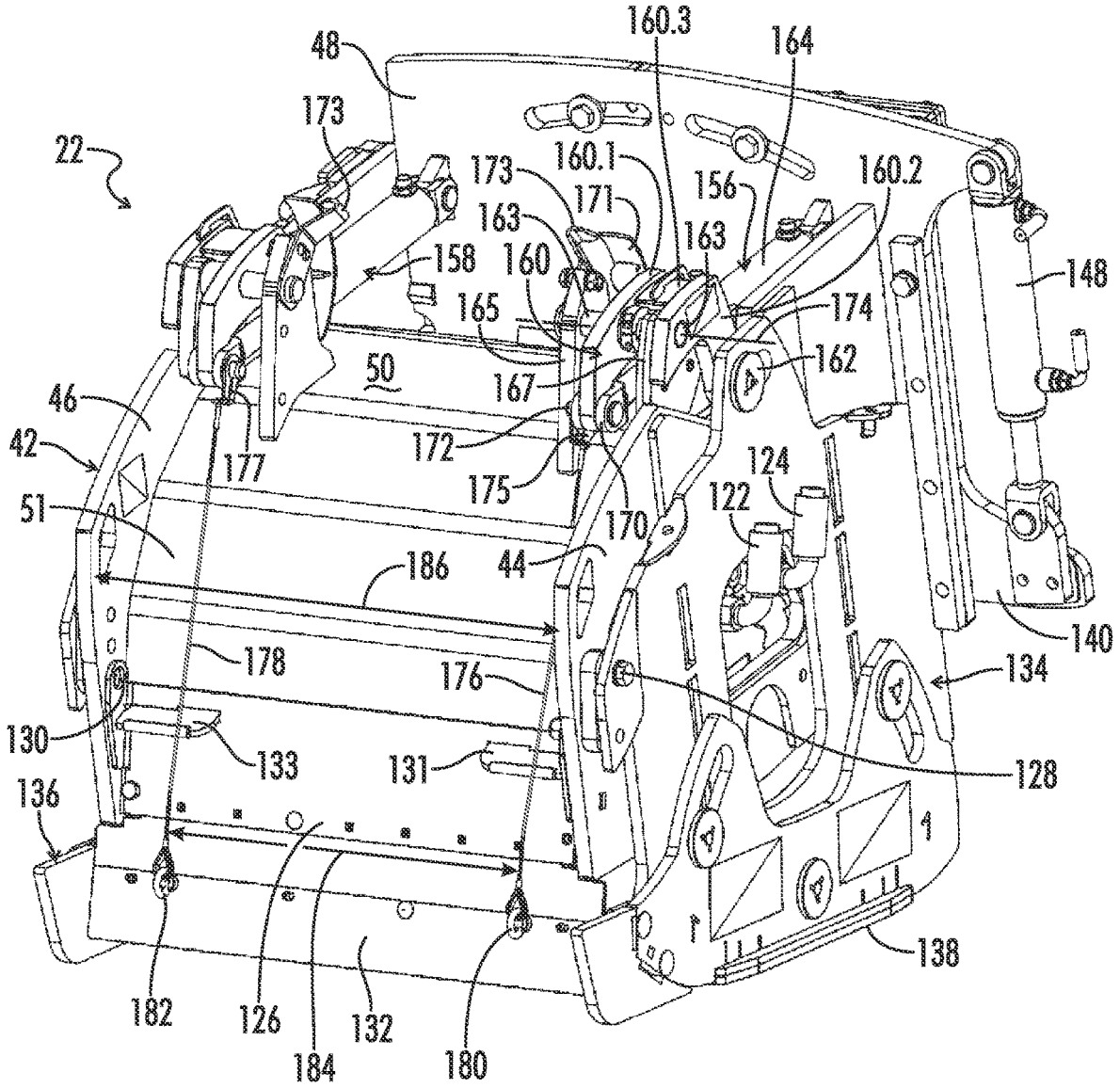
FIG. 2 is left front perspective view of the milling attachment.
Figure 3:
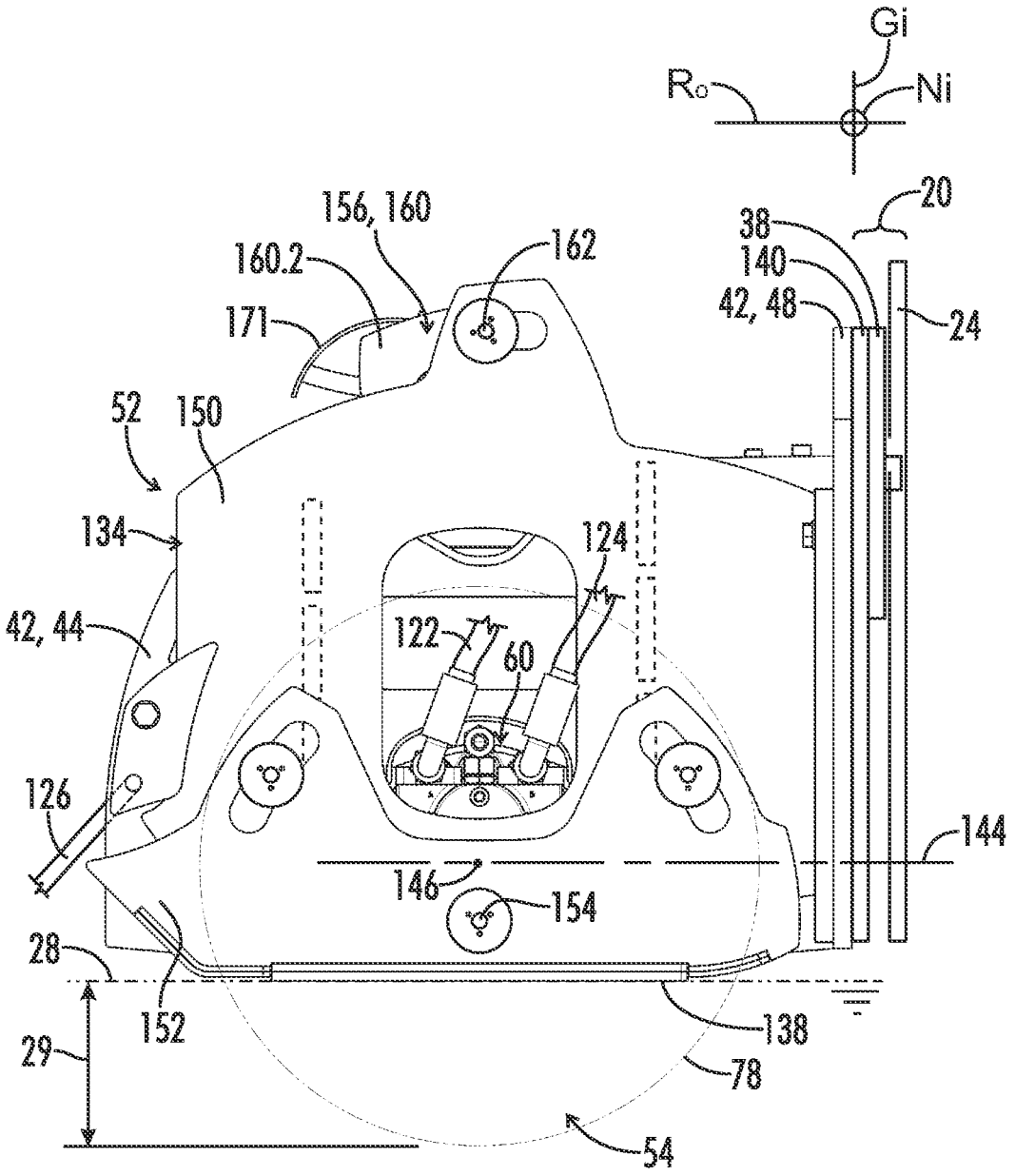
FIG. 3 is a left side elevation of the milling attachment showing the left adjustable side plate in a raised position.

FIG. 2 shows a left front perspective view of the milling attachment 22, and FIG. 3 shows a left side elevation view of the milling attachment 22. In FIG. 3 the work machine 20 and its connection to the milling attachment 22 are schematically represented as further described below.

The milling attachment 22 includes a milling attachment frame 42 including first and second integral frame side walls 44 and 46, a frame back wall 48 and a frame top 50. The first and second integral frame side walls 44 and 46, the frame back wall 48 and the frame top 50 collectively form a milling drum housing 52 within which is received a milling drum 54. A motor mounting plate 56 (see FIG. 8) is removably mounted on the second frame side wall 46 by a plurality of threaded connectors such as 58.

Figure 8:
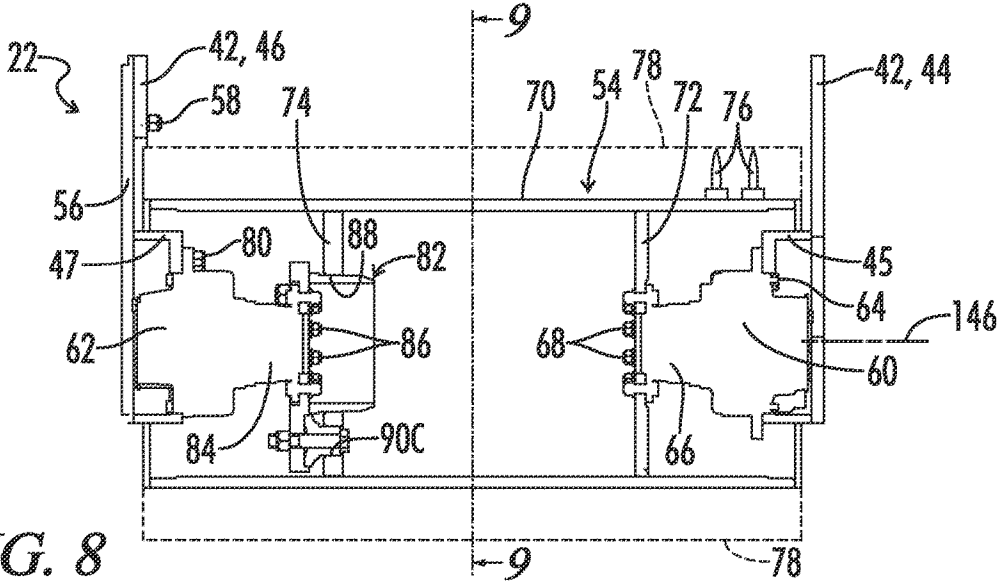
FIG. 8 is an elevation cross-section view taken along line 8-8 of FIG. 7 showing the internal construction of the milling drum and the attachment of the drive motors to the milling drum.

As best seen in FIG. 8 the milling drum 54 includes a tubular milling drum body or casing 70 and first and second internal drum mounting flanges 72 and 74 extending radially inward from the casing 70. A plurality of cutting bits 76, only two of which are shown in FIG. 8, are mounted on the casing 70 and as the milling drum 54 is rotated about a milling drum axis 146 the cutting bits 76 define a cutting circle or milling circle shown in dashed lines as 78.

Dual Drive Arrangement:

As further seen in FIG. 8, the milling attachment 22 is a dual drive milling attachment including first and second drive motors 60 and 62. The motors 60 and 62 are shown as hydraulic motors, but in another embodiment they could be electric motors. The first drive motor 60 is mounted on the first frame side wall 44 via an adapter 45 by a plurality of threaded connectors such as 64 and includes a drive end 66 connected to the first drum mounting flange 72 by a plurality of threaded fasteners 68.

The second drive motor 62 is mounted on the motor mounting plate 56 via an adapter 47 by a plurality of threaded connectors such as 80. A stab-in non-threaded connector 82 is mounted on a drive end 84 of second motor 62 by a plurality of threaded connectors 86. As can be seen in FIG. 8 the second drive motor 62 is connected to the second drum mounting flange 74 by the stab-in non-threaded connector 82.

Figure 9:
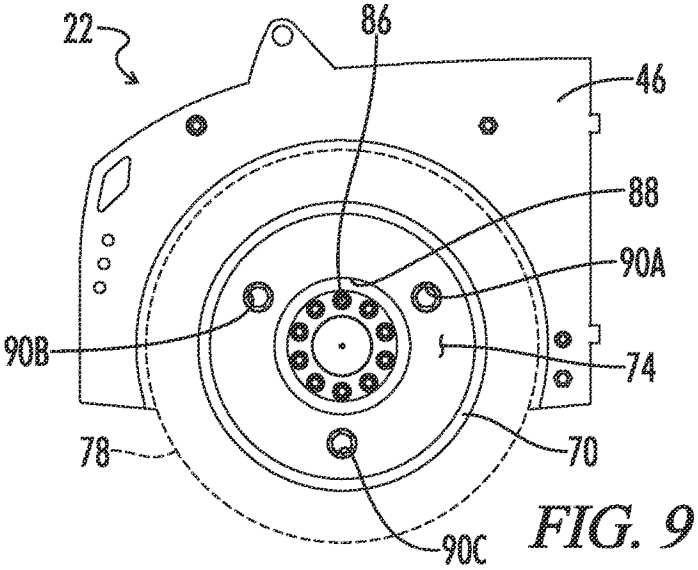
FIG. 9 is an elevation cross-section view taken along line 9-9 of FIG. 8.
Figure 7:
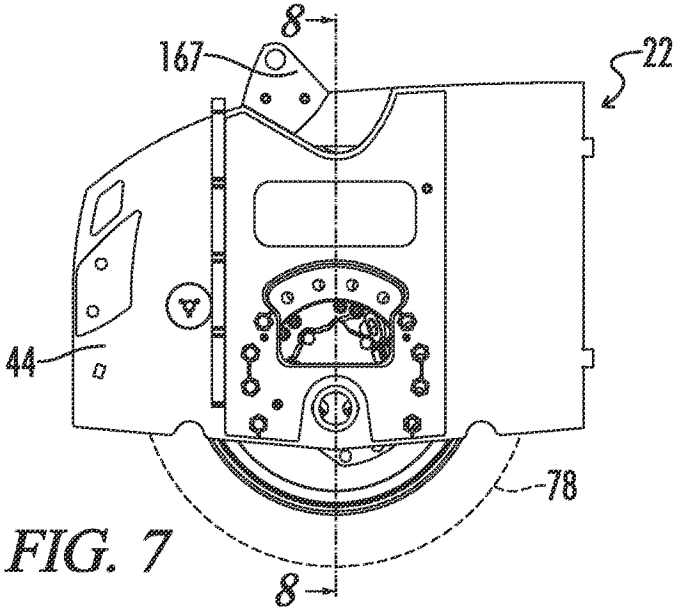
FIG. 7 is a left side elevation view of the milling attachment with the left adjustable side plate removed so that the left frame side wall is exposed.

As best seen in FIG. 9 the second drum mounting flange 74 includes a central opening 88 and a plurality of radially offset openings 90A, 90B and 90C. The openings 88 and 90 may be circular openings. The central opening 88 has a diameter preferably equal to at least 40% of an inside diameter of the drum casing 70 in order to provide access to the fasteners 68 to connect the first drive motor 60 to the first drum mounting flange 72.

Figure 10:
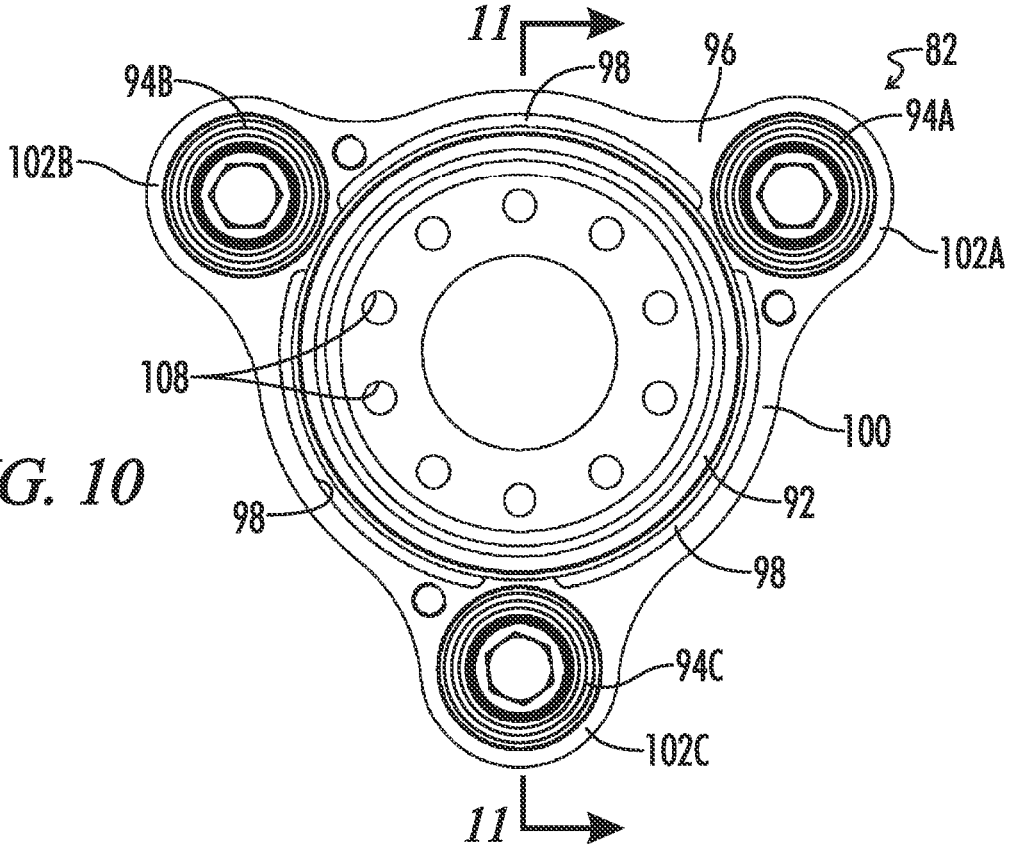
FIG. 10 is an end elevation view of the stab-in non-threaded connector used to connect the second hydraulic drive motor to the milling drum.
Figure 11:
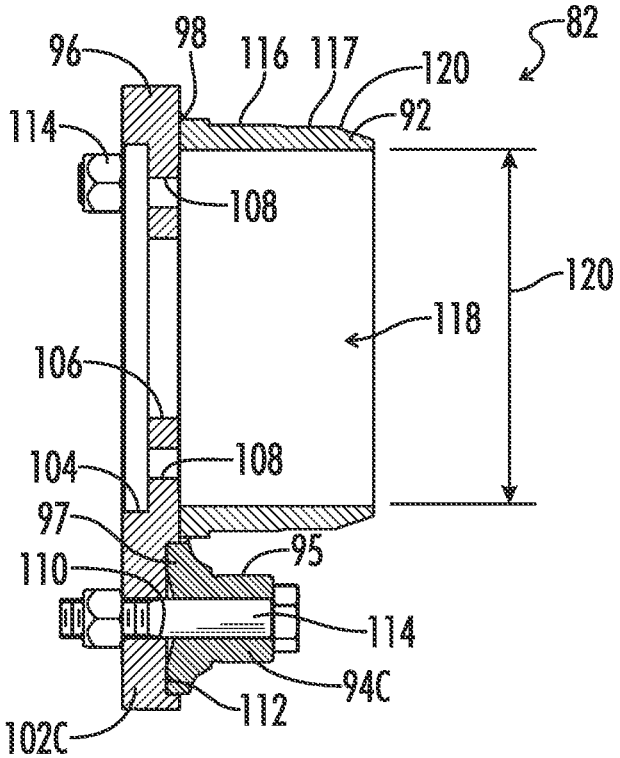
FIG. 11 is an elevation cross-section view taken along line 11-11 of FIG. 10.

The stab-in non-threaded connector 82 is shown in isolation in FIGS. 10 and 11. Connector 82 includes a center hub 92 and a plurality of radially offset pins 94A, 94B and 94C. As seen in FIG. 8 the center hub 92 is configured to be received in the central opening 88 and the pins 94A, 94B and 94C are configured to be received in the radially offset openings 90A, 90B and 90C, respectively. In an embodiment there are three pins 94. In another embodiment there may be more than three pins 94. In an embodiment the pins 94 may be equally spaced circumferentially around the center hub 92.

The stab-in non-threaded connector 82 includes a base plate 96 to which the center hub 92 is welded as indicated at 98. As best seen in FIG. 10 the base plate 96 may have a generally circular mid portion 100 with three protruding lobes 102A, 102B and 102C. The stab-in non-threaded connector 82 may be manufactured by starting with a sheet of steel having a profile as seen in FIG. 10. Then a piece of tubular steel stock, which will form the hub 92, may be welded to the steel sheet which forms the base plate 96. Then the various recesses and surfaces shown in FIG. 11 may be formed by machining processes. The base plate 96 may have a circular recess 104 formed therein for receiving the drive end 84 of second drive motor 62. A central opening 106 may be formed through the base plate 96 concentric with the circular recess 104. Surrounding the central opening 106 a plurality of holes 108 may be provided for receiving the threaded fasteners 86 (see FIG. 8). Each of the three lobes 102A, 102B and 102C may have a bolt hole 110 formed therethrough and surrounded by a countersunk recess 112 on the same side as the hub 92. Pins 94A, 94B and 94C are received in the three countersunk recesses 112 and held in place by bolts 114. Each pin 94 may include a cylindrical end portion 95 to be received in its respective radially offset opening 90, and an enlarged base portion 97 which sits in its respective countersunk recess 112.

The hub 92 may have a cylindrical outer bearing surface 116 formed thereon and configured to be closely received in the central opening 88 of the second drum mounting flange 74. Adjacent the cylindrical outer bearing surface 116 may be a reduced diameter guide surface 117 and then a tapered axial end 120 configured to guide the cylindrical outer bearing surface 116 into the central opening 88 during the stab-in procedure. The hub 92 has an open axial end 118 defining an inner access opening to provide access to the threaded fasteners 86. Access opening 118 may be defined by an inside diameter 120 of hub which is preferably equal to at least 40% of an inside diameter of the drum casing 70.

As seen in FIG. 8, the first and second hydraulic motors 60 and 62 may be completely received between the first frame side wall 44 and the motor mounting plate 56, thus providing a compact assembly.

The arrangement described above for the mounting of the hydraulic motors 60 and 62 provides for an improved method of installing and/or removing the milling drum 54 in the milling attachment 22, especially as compared to prior art dual motor milling attachment designs. In prior art designs both of the drive motors are connected to the milling drum by threaded connectors, thus requiring a complex mechanical arrangement to allow for the assembly and disassembly of the milling drum with the milling attachment and to allow for thermal expansion of the milling drum 54 during milling operation.

With the arrangement of the present disclosure the milling drum 54 may be removed by a method including steps of:

(a) removing the motor mounting plate 56 and the second drive motor 62 by removing the plurality of threaded fasteners 58 to disconnect the motor mounting plate 56 from the second frame side wall 46 and withdrawing the stab-in non-threaded connector 82 from the second drum mounting flange 74;

(b) disconnecting the first drive motor 60 from the first drum mounting flange 72 by removing the plurality of threaded fasteners 68; and (c) removing the milling drum 54 from the frame 42 of the milling attachment 22.

With this arrangement the milling drum 54 may be removed without disconnecting any hydraulic hoses such as 122 and 124 (see FIG. 3) from the hydraulic motors 60 or 62.

In the above procedure the milling drum 54 may be rested on a wooden pallet or the like prior to step (a) so that the milling drum 54 is temporarily supported during steps (a) and (b). Then step (c) may be performed with the aid of a fork lift or the like engaging the wooden pallet to remove the milling drum 54.

Installation of the milling drum may be performed by a reversal of the steps described above. To install the milling drum 54 it is first moved into position adjacent the first drive motor 60 and the first set of threaded fasteners 68 are installed to connect the milling drum to the first drive motor 60. Then the stab-in non-threaded connector 82, which is attached to the motor mounting plate 56 is stabbed into the milling drum 54 by an axial sliding motion so that the center hub 92 is received in the center opening 88 of second drum mounting flange 74 and the pins 94 are received in the radially offset openings 90. Then the motor mounting plate 56 is attached to the second frame side wall 46 by threaded fasteners 58 to complete the installation.

Adjustable Housing Cover:

As best seen in FIG. 2, the frame top 50 of the milling drum housing 52 may include a movable front cover portion 126. The movable front cover portion 126 may be in the form of an elongated plate which is pivotally connected to the first and second frame side walls 44 and 46 by pivot pins 128 and 130. A lower edge portion 132 of the movable front cover portion 126 may be formed of a flexible elastomeric material to aid in sealing against the ground surface 28.

First and second adjustable side plates 134 and 136 are mounted on the first and second frame side walls 44 and 46, respectively. Each side plate has a ground engaging portion 138 which is configured for engaging the ground surface 28. Ground engaging portions 138 may be in the form of a skid. The details of construction of the first adjustable side plate 134, and further details of the mounting of milling attachment 22 on the work machine 20 are seen in FIG. 3.

A three-dimensional reference system is shown in FIG. 3 wherein Ro is the roll axis of the work machine 20, Gi is the yaw axis of the work machine 20 and Ni is the pitch axis of the work machine 20. The reference system also applies to the milling attachment 22 when it is held in the position shown in FIG. 3. The work machine 20 is schematically indicated in FIG. 3 as including the machine frame 24 and the attachment mounting frame 38. Between the attachment mounting frame 38 and the back plate 48 of the milling attachment frame 42 is a lateral displacement device 140 by which the milling attachment 22 may be displaced parallel to the rotational axis 146 of milling drum 54 and also parallel to the pitch axis Ni of work machine 20 in a translatory fashion over a displacement width that is specified by the work machine 20 and/or by the mounting frame 38 and/or by the lateral displacement device 140 itself.

Figure 12:
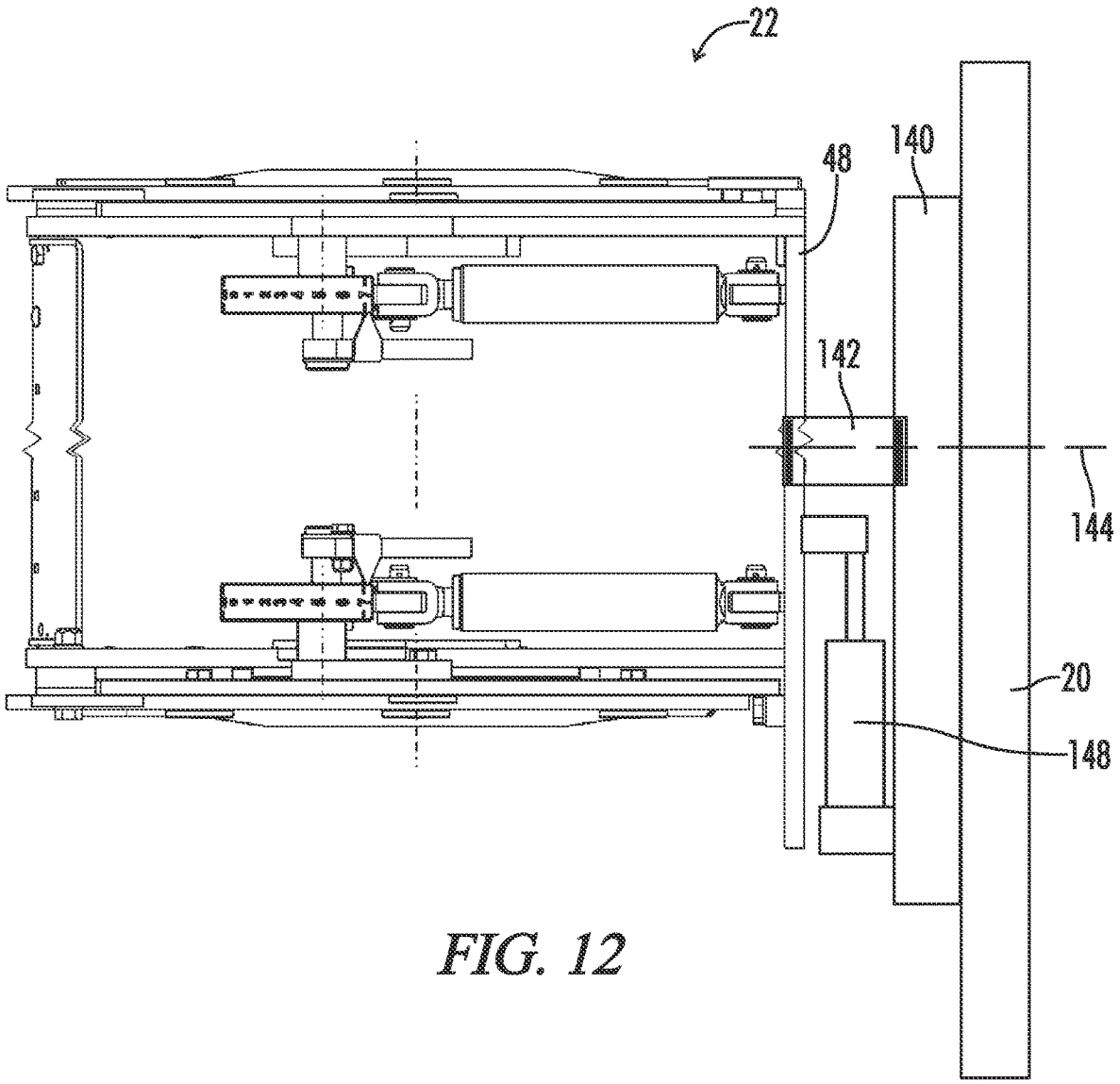
FIG. 12 is a top view similar FIG. 5 and schematically showing a pivotal connection between the milling attachment and the work machine which allows the milling attachment to be tilted.

As is further schematically shown in FIG. 12 the back plate 48 in turn may be connected to the lateral displacement device 140 by a pivotal mounting 142 so that the milling attachment 22 is tiltable about a tilt axis 144 that is parallel to the roll axis Ro of work machine 20 and/or orthogonal to the rotational axis 146 of the milling drum 54. This allows the work machine 20 to perform a rolling motion about its roll axis Ro without thereby disadvantageously influencing the milling attachment 22 during a ground milling operation. The tilt axis 144 preferably intersects milling drum axis 146. Alternatively, tilt axis 144 may cross milling drum axis 146, preferably at a distance of no more than half of the radius of milling circle 78, in order to keep a tilt arm between tilt axis 144 and milling drum axis 146 advantageously short. Using a tilt actuator 148 it is possible to control a tilt angle of the milling attachment 22 relative to the work machine 20.

In the illustrated embodiment the first adjustable side plate 134 is formed in two parts, namely an upper first lift component 150 and a lower first swivel component 152 supported on the first lift component 150 to be swivel able about a first swivel axis 154. The ground engaging portion or skid 138 is integrally formed on the first swivel component 152. The skid 138 may also be a replaceable wear part that is attached to the side plate in a replaceable manner.

A first actuator 156 is operably associated with the first adjustable side plate 134 for raising and lowering the first adjustable side plate 134 relative to the first frame side wall 44 to adjust the height of the first frame side wall 44 and the milling drum 54 relative to the ground surface 28. Similarly, a second actuator 158 is operably associated with the second adjustable side plate 136 for raising and lowering the second adjustable side plate 136 relative to the second frame side wall 46 to adjust the height of the second frame side wall 46 and the milling drum 54 relative to the ground surface 28. The first and second actuators 156 and 158 are independently operable so that a milling depth of the milling drum 54 can be adjusted on either side of the milling attachment 22.

The first actuator 156 includes a first pivot arm 160 and a first hydraulic cylinder 164. The first pivot arm 160 is mounted on the milling attachment frame 42 and operably connected to the first adjustable side plate 134 at connection 162. The first pivot arm 160 is a three-dimensional structure including an axially inner arm member 160.1, an axially outer arm member 160.2 and a bridge 160.3 rigidly connecting the axially inner and outer arm members 160.1 and 160.2. A pivot shaft 163 extends between projections 165 and 167 of the milling attachment frame 42. The axially inner and outer arm members 160.1 and 160.2 are mounted on the shaft 163 so that the entire pivot arm 160 is pivotable about axis 174 of shaft 163. An arcuate shaped scale 171 is fixed to and pivots with pivot arm 160. A pointer 173 (see FIG. 5) is fixed relative to the milling attachment frame 42 so that as the first pivot arm 160 is pivoted by the hydraulic cylinder 164 the scale 171 moves relative to the pointer 173 to provide a visual indication of the height of the first side plate 134 and the corresponding milling depth 29.

First actuator 156 further includes the first hydraulic cylinder 164 (see FIG. 5) including a rear end 166 pivotally connected to the back plate 48 of the milling attachment frame 42 at pivot pin 168. A forward end 170 of hydraulic cylinder 164 is pivotally connected to the axially inner arm member 160.1 of first pivot arm 160 at pivot pin 172.

The axially outer arm member 160.2 is connected to the first adjustable side plate 134 at the previously mentioned connection 162.

The first pivot arm 160 pivots relative to milling attachment frame 42 about pivot axis 174. As the pivot arm 160 pivots the interaction of connector 162 with the first adjustable side plate 134 raises or lowers the first adjustable side plate 134. The forward end 170 of hydraulic cylinder 164 is retracted to raise the first adjustable side plate 134 and extended to lower the first adjustable side plate 134.

The second actuator 158 is constructed substantially the same as the first actuator 156, including a hydraulic cylinder and a pivot arm, like the hydraulic cylinder 164 and the pivot arm 160.

Figure 5:
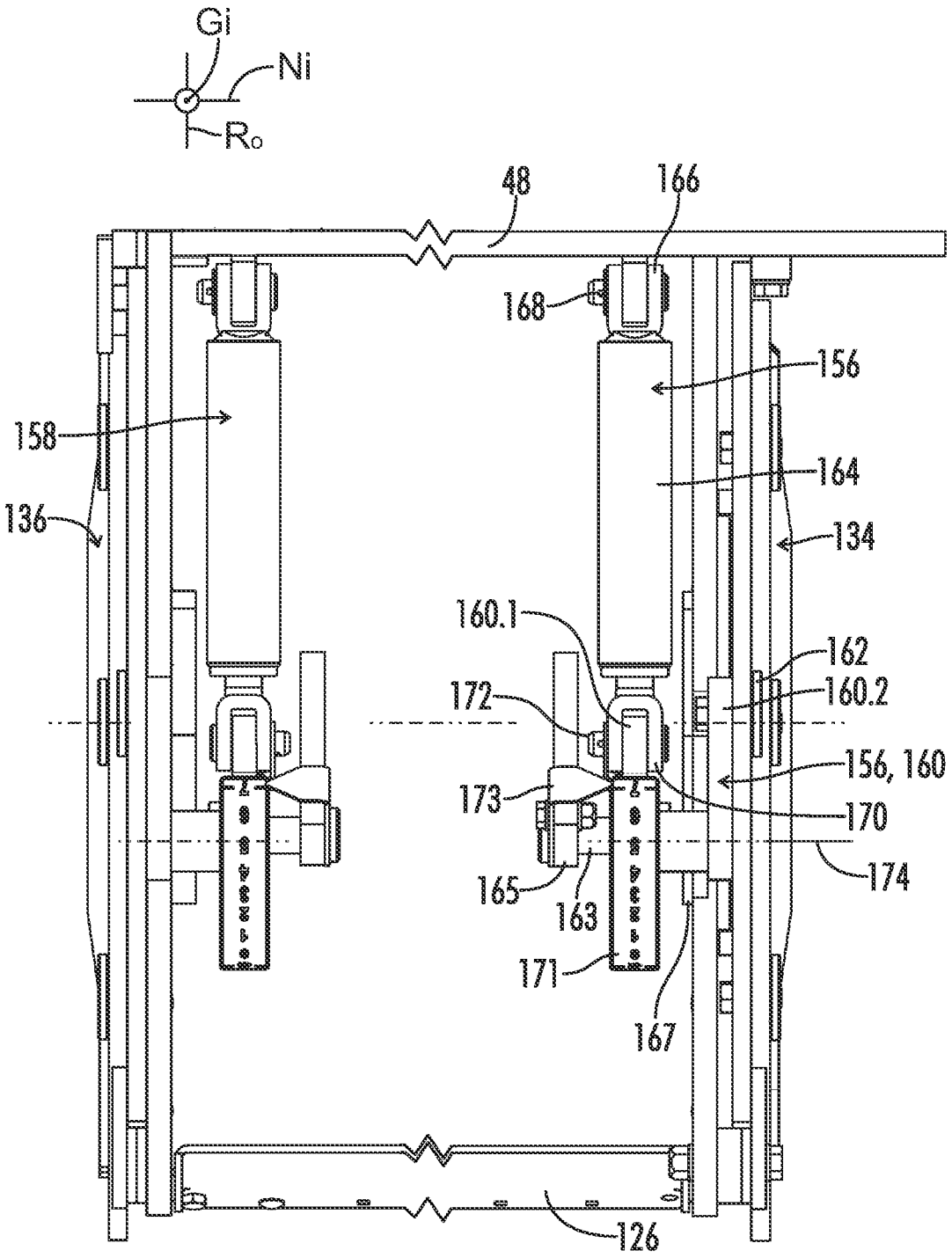
FIG. 5 is a top view of the milling attachment showing the side plate actuators in positions corresponding to the raised positions of the side plates.

As can be appreciated from FIGS. 2 and 5 the hydraulic cylinders such as 164 of the first and second actuators 156 and 158 may be oriented primarily horizontally which will be understood to be within plus or minus ten degrees of horizontal when the milling attachment 22 is resting on a horizontal surface 28.

It will be appreciated that in addition to raising and lowering the milling attachment frame 42 relative to the ground surface 28 to adjust the milling depth 29 of milling drum 54, the adjustable side plates 134 and 136 in combination with the first and second frame side walls 44 and 46 function to enclose the milling drum 54 so as to capture the milled material created by the operation of the milling drum. Similarly, the movable front cover portion 126 can tilt up and down to enclose the front of the milling drum housing 52.

In prior art milling attachments such tiltable front cover portions typically operated just by the force of gravity pushing them down and engagement with the ground surface 28 pushing them up. The present disclosure provides an improved arrangement whereby the first actuator 156 is connected to the movable front cover portion 126 by a first actuator extension 176 configured such that the movable front cover portion 126 is raised or lowered when the first adjustable side plate 134 is raised or lowered relative to the milling attachment frame 42. Similarly, the second actuator 158 is connected to the movable front cover portion 126 by a second actuator extension 178.

The first and second actuator extensions 176 and 178 may be in the form of cables 176 and 178 connected between the pivotable front cover portion 126 and the forward ends 170 of their respective actuator hydraulic cylinders such as 164. The cables 176 and 178 are configured such that when the forward end 170 of the hydraulic cylinder 164 is retracted the cable pivots the front cover portion 126 upwards. In other embodiments the actuator extensions 176 and 178 may take other forms, such as for example linkages connecting the actuators to the front cover portion 126.

Figure 4:
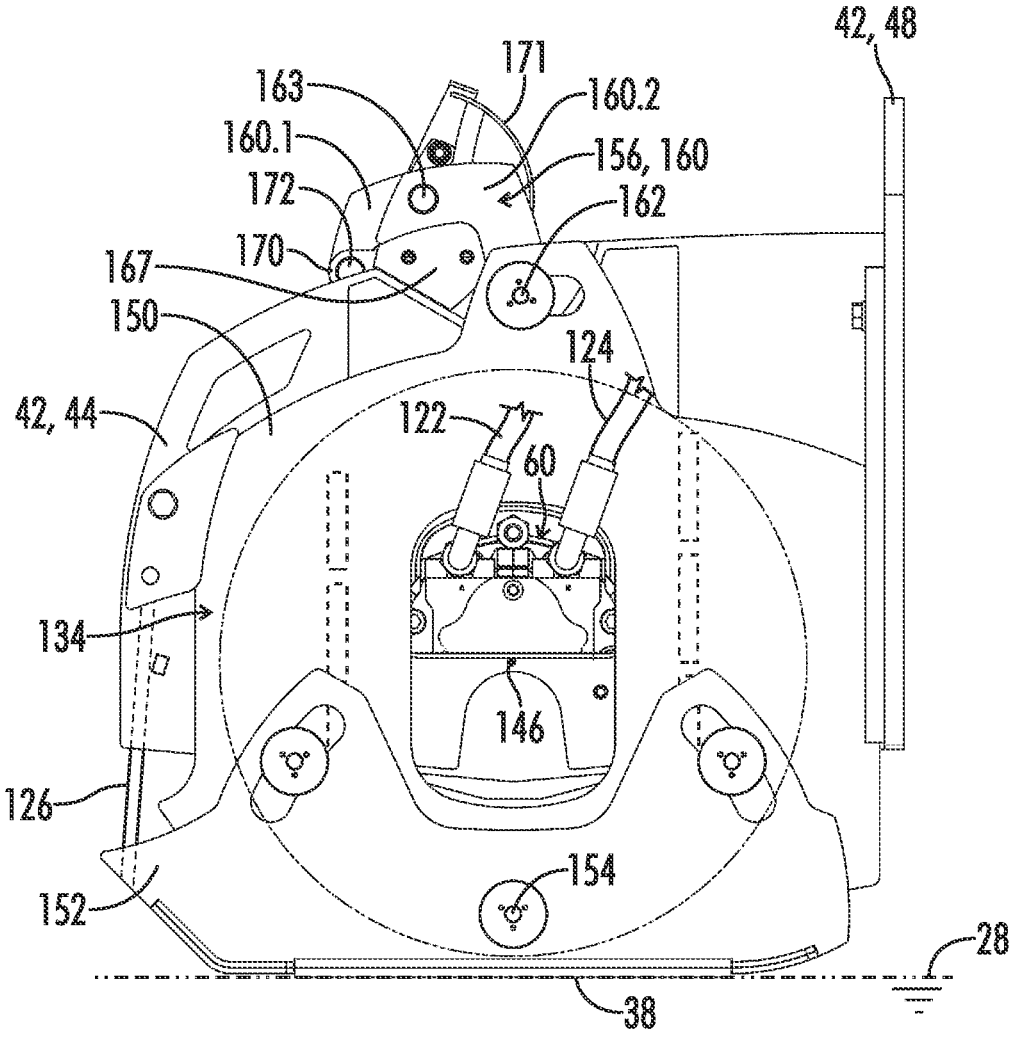
FIG. 4 is a left side elevation of the milling attachment showing the left adjustable side plate in a lowered position.
Figure 6:
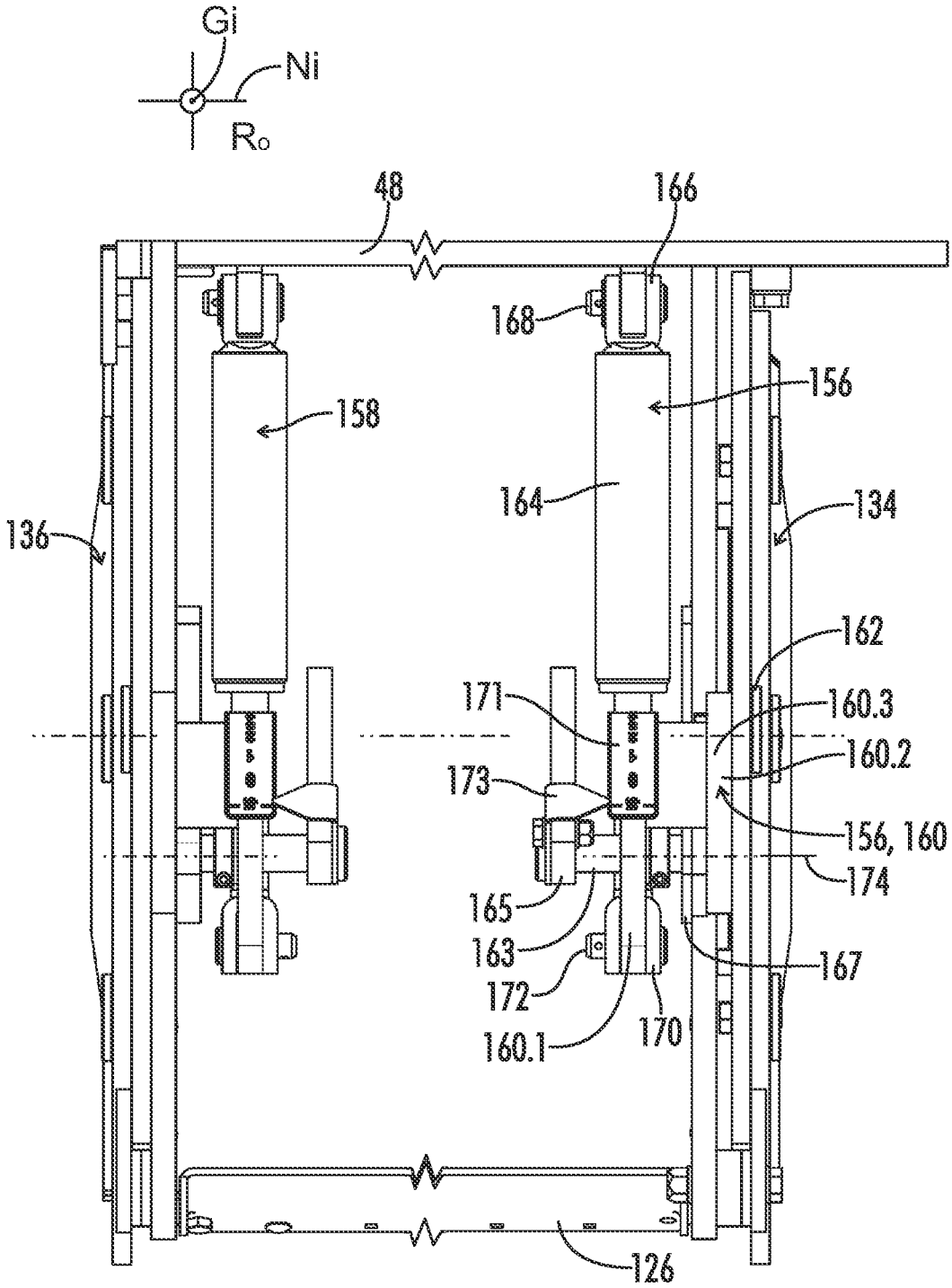
FIG. 6 is a top view of the milling attachment showing the side plate actuators in positions corresponding to the lowered positions of the side plates.

First hydraulic cylinder 164 is shown in FIG. 5 in a fully retracted position corresponding to the uppermost raised position of the first adjustable side plate 134 seen in FIG. 3 and corresponding to the upwardmost pivoted position of the pivotable front cover portion 126. First hydraulic cylinder 164 is shown in FIGS. 2 and 6 in a fully extended position corresponding to the lowermost position of the first adjustable side plate 134 seen in FIG. 4, and corresponding to the lowermost pivoted position of the pivotable front cover portion 126 as seen in FIG. 2. The upper and lower pivotal positions of the pivotable front cover portion 126 are schematically represented in FIGS. 3 and 4. It is noted that no attempt has been made to depict the movement of the pivotal front cover portion 126 between FIGS. 5 and 6.

As can best be seen in FIG. 2 the frame top 50 includes a rounded forward top portion 51 curving forwardly and downwardly toward the ground surface 28. The cables 176 and 178 may slide upon the rounded forward top portion 51 of the frame top 50 when the movable front cover portion 126 is raised or lowered. The cables 176 and 178 may be further guided by protrusions 131 and 133 see in FIG. 2.

As previously noted, the actuators 156 and 158 are independently operable. Thus, if either hydraulic cylinder such as 164 is retracted the pivotable front cover portion 126 will be pulled upward. When the actuator or actuators that have pulled the pivoted front cover portion 126 upward are extended, then the pivoted front cover portion will be lowered by gravitational force.

As seen in FIG. 2 lower ends of the first and second cables 176 and 178 are connected to the pivoted front cover portion 126 at spaced connections 180 and 182 separated by a distance 184 greater than one-half of a distance 186 separating the first and second frame side walls 44 and 46. The upper ends of the cables 176 and 178 are shown as connected to clips 175 and 177, respectively, which are connected to the pivot pins such as 172 which connect the forward ends 170 of cylinders 164 to the respective pivot arms 160. In another embodiment the cables 176 and 178 could be connected to other moving parts of the actuators 156 and 158, such as being directly connected to the pivot arms such as 160.

By the arrangement described above the actuators 156 and 158 of the present disclosure provide a dual function to control the raising and lowering of both the side plates 134, 136 and of the pivoted front cover portion 126. As compared to the prior art gravity operated front cover portions, this reduces wear and tear on the front cover portion 126 and provides for a more reliable sealing of the milling drum housing 52.

It is noted that in another embodiment, not shown, the kinematic arrangement of the hydraulic cylinders with the side plates could be reversed so that the cylinders are extended to raise the side plates and retracted to lower the side plates. In such an arrangement a redirecting device such as a deflection pulley could be used to reverse the operation of the cables 176 and 178 so that the extension of the cylinders would raise the movable front cover portion 126 and the retraction of the cylinders would lower the movable front cover portion 126.

Remote Tilt Control:

As described above with reference to FIGS. 3 and 12, the milling attachment 22 may be mounted with a pivotal mount 142 so that the milling attachment 22 may be tilted to the right or left about a tilt axis 144 relative to the work machine 20. This tilting action is controlled by the hydraulic tilt cylinder 148 best seen in FIG. 2.

Figure 13:
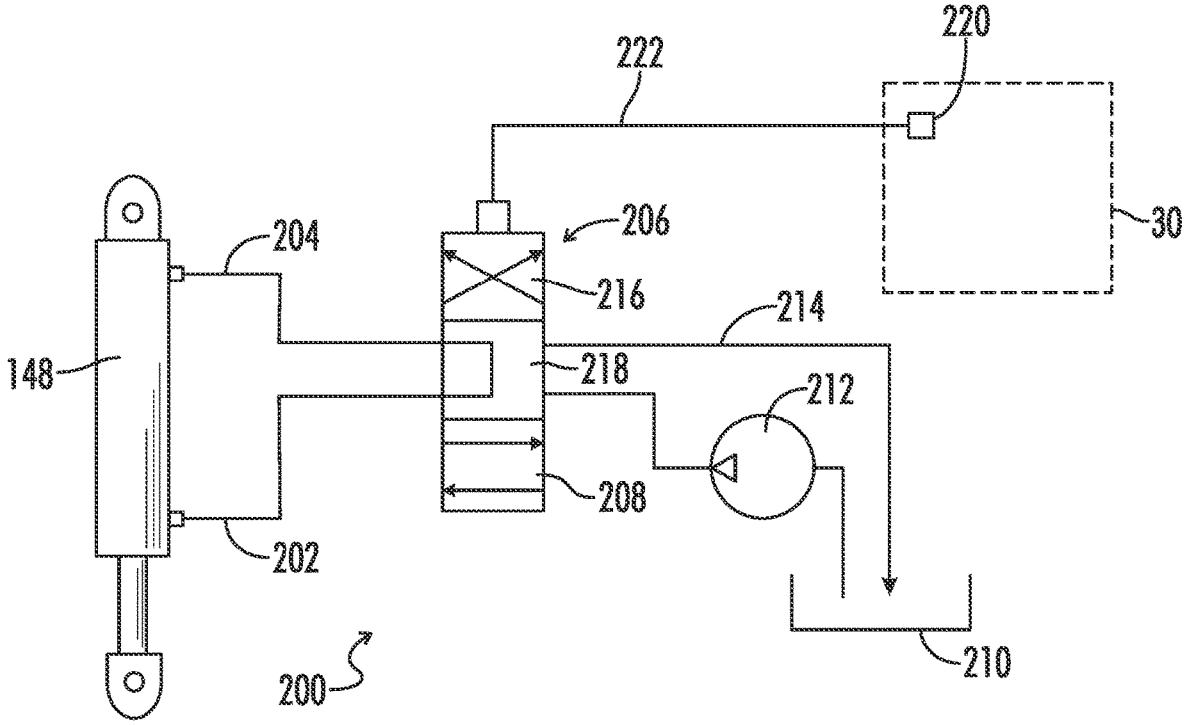
FIG. 13 is a schematic drawing of a hydraulic control circuit for the tilt mechanism.

As schematically shown in FIG. 13, a hydraulic circuit 200 may be provided for operation and control of the hydraulic tilt cylinder 148. The hydraulic tilt cylinder 148 may be a double acting cylinder which can push or pull to tilt the milling attachment 22 to the right or left, respectively. The hydraulic tilt cylinder 148 is powered by hydraulic fluid provided through two hydraulic lines 202 and 204 which may operate as fluid supply and return lines.

Flow of hydraulic fluid to and from the lines 202 and 204 is controlled by a valve 206 which has at least three positions.

In a first position 208 hydraulic fluid from sump 210 is provided under pressure by pump 212 to the first hydraulic line 202 to retract the hydraulic tilt cylinder 148. Simultaneously return fluid passes through the second line 204 to return line 214 and to the sump 210.

In a second position 216 hydraulic fluid from sump 210 is provided under pressure by pump 212 to the second hydraulic line 204 to extend the hydraulic tilt cylinder 148. Simultaneously return fluid passes through the first line 202 to return line 214 and to the sump 210.

The first and second positions 208 and 216 may be referred to as active tilt modes wherein hydraulic fluid under pressure is applied to the hydraulic tilt cylinder 148 to tilt the milling attachment 22.

In a third position 218 the two hydraulic lines 202 and 204 are connected together in a closed loop and the hydraulic cylinder 148 is free to float in either direction under the forces imposed by the milling attachment 22. The third position 218 may be referred to as a floating mode in which the hydraulic tilt cylinder 148 does not apply any tilting force to the milling attachment 22.

By the present disclosure a tilt control 220 is placed within the operator's station 30 so that the tilt control 220 may be conveniently manipulated by the operator to switch the hydraulic circuit 200 between the active tilt mode 208 or 216 and the floating mode 218 during the milling operation. The tilt control 220 may be provided in various embodiments.

In one embodiment the valve 206 may be an electromechanical control valve and the tilt control 220 may be a switch, knob or other input to an electrical controller which sends a control signal via control line 222 to the valve 206 to switch the position of the valve 206.

In another embodiment the valve 206 may be a manually operated valve and the valve 206 itself may be placed in the operator's station 30. This will require the hydraulic lines 202 and 204 to be run into the operator's station 30. Then the tilt control 220 may be embodied as a handle 220 for manual operation of the valve 206 located within the operator's station 30.

In one method of using the tilt control 220 the operator may start a milling operation with both adjustable side plates 134 and 136 engaging an asphalt surface 28 which is to be milled. The milling operation may start with the valve 206 in the free-floating position 218. The milling operation may continue until one of the adjustable side plates 134 or 136 reaches a different surface, such as for example a soft shoulder of the street. At that point the operator may engage the tilt control 220 to switch the valve 206 to either position 208 or 216 to actively tilt the milling attachment 22 relative to work machine 20 to prevent the one side plate from digging into the soft ground surface. With the present system this can be performed without interrupting the milling operation.

Figure 14:
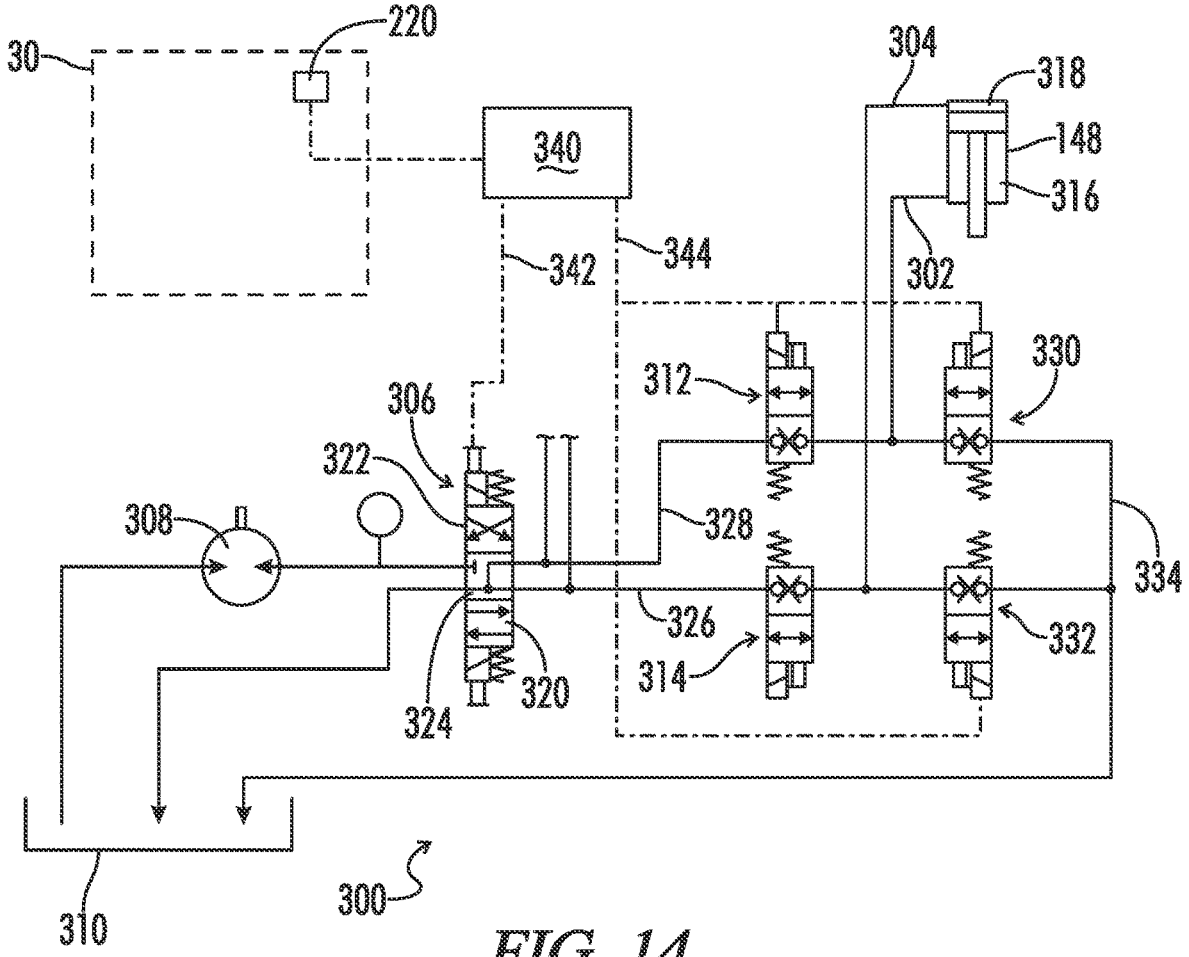
FIG. 14 is a schematic drawing of a second embodiment of a hydraulic control circuit for the tilt mechanism.

FIG. 14 shows an alternative embodiment of a hydraulic circuit for operation and control of the hydraulic tilt cylinder 148. The hydraulic circuit of FIG. 14 is designated by the number 300. The hydraulic tilt cylinder 148 is powered by hydraulic fluid provided through two hydraulic lines 302 and 304 which may operate as fluid supply and return lines.

A master control valve 306 controls flow of hydraulic fluid from pump 308 and return of hydraulic fluid to tank 310. Master control valve 306 is a three position valve and it controls flow to and from other valves associated with each hydraulically powered component.

The tilt cylinder 148 has associated there with two tilt control valves 312 and 314. Each of the tilt control valves 312 and 314 is a two-position valve that either permits or blocks flow from the master control valve 306 to the hydraulic lines 302 and 304 and thus to the two pressure chambers 316 and 318 of the tilt cylinder 148 to tilt the milling attachment 22 to the right or left.

The master control valve 306 has two active positions 320 and 322 which can direct pressurized hydraulic fluid to either of the intermediate lines 326 or 328. A third position 324 is a neutral position which communicates both lines 326 and 328 to the tank 310. Thus, with the master control valve in either position 320 or 322 and with the tilt control valves 312 and 314 in their open positions the milling attachment 22 is actively tilted to the right or left.

With the embodiment of FIG. 14 a floating mode for the tilt cylinder 148 is provided by two float control valves 330 and 332. Each of the float control valves 330 and 332 is a two-position valve that either permits or blocks flow from the hydraulic lines 302 and 304 back to the tank 310. When the tilt control valves 312 and 314 are in their closed positions and the float control valves 330 and 332 are in their open positions the hydraulic lines 302 and 304 and thus the pressure chambers 316 and 318 of tilt cylinder 148 are open to a return line 334 and to each other. In this arrangement the hydraulic cylinder 148 is free to float in either direction under the forces imposed by the milling attachment 22. This arrangement may be referred to as a floating mode in which the hydraulic tilt cylinder 148 does not apply any tilting force to the milling attachment 22.

The tilt control 220 is again placed within the operator's station 30 so that the tilt control 220 may be conveniently manipulated by the operator to switch the hydraulic circuit 300 between the active tilt mode and the floating mode during the milling operation. The tilt control 220 may be a switch, knob or other input to an electrical controller 340 which sends control signals via control lines 342, 344 to the valves 306, 312, 314, 330 and 332.

Thus, it is seen that the apparatus and methods of the present disclosure readily achieve the ends and advantages mentioned as well as those inherent therein. While certain preferred embodiments of the disclosure have been illustrated and described for present purposes, numerous changes in the arrangement and construction of parts and steps may be made by those skilled in the art, which changes are encompassed within the scope and spirit of the present disclosure as defined by the appended claims. Each disclosed feature or embodiment may be combined with any of the other disclosed features or embodiments.

What is claimed is:

1. A milling attachment for a work machine, comprising:
a frame including first and second frame side walls;
a milling drum including first and second drum mounting flanges;
a motor mounting plate removably mounted on the second frame side wall;
a first drive motor mounted on the first frame side wall and including a drive end connected to the first drum mounting flange by a plurality of threaded fasteners; and
a second drive motor mounted on the motor mounting plate and connected to the second drum mounting flange by a stab-in non-threaded connector;
wherein the second drum mounting flange includes a central opening and a plurality of radially offset openings;
wherein the stab-in non-threaded connector includes a center hub mounted on the second drive motor and configured to be received in the central opening, and a plurality of radially offset pins configured to be received in the plurality of radially offset openings; and
wherein the center hub includes a cylindrical outer bearing surface configured to be closely received in the central opening, and the center hub includes a tapered axial end configured to guide the cylindrical outer bearing surface into the central opening.

2. The milling attachment of claim 1, wherein:
the plurality of radially offset pins includes at least three radially offset pins.

3. The milling attachment of claim 1, wherein:
the plurality of radially offset pins are equally spaced circumferentially around the center hub.

4. The milling attachment of claim 1, wherein:
the center hub includes an inside diameter equal to at least 40% of an inside diameter of a drum casing of the milling drum.

5. A milling attachment for a work machine, comprising:
a frame including first and second frame side walls;
a milling drum including first and second drum mounting flanges;
a motor mounting plate removably mounted on the second frame side wall;
a first drive motor mounted on the first frame side wall and including a drive end connected to the first drum mounting flange by a plurality of threaded fasteners; and
a second drive motor mounted on the motor mounting plate and connected to the second drum mounting flange by a stab-in non-threaded connector;
wherein the second drum mounting flange includes a central opening and a plurality of radially offset openings;
wherein the stab-in non-threaded connector includes a center hub mounted on the second drive motor and configured to be received in the central opening, and a plurality of radially offset pins configured to be received in the plurality of radially offset openings; and
wherein the center hub has an open axial end to allow access through the center hub to a plurality of fasteners connecting the center hub to the second drive motor.

6. The milling attachment of claim 5, wherein:
the plurality of radially offset pins includes at least three radially offset pins.

7. The milling attachment of claim 5, wherein:
the plurality of radially offset pins are equally spaced circumferentially around the center hub.

8. The milling attachment of claim 5, wherein:
the center hub includes an inside diameter equal to at least 40% of an inside diameter of a drum casing of the milling drum.

9. The milling attachment of claim 5, wherein:
the central opening of the second drum mounting flange has a diameter equal to at least 40% of an inside diameter of a drum casing of the milling drum.

10. The milling attachment of claim 5, wherein:
the first and second drive motors are hydraulic motors.

11. The milling attachment of claim 5, wherein:
the first and second hydraulic motors are completely received between the first frame side wall and the motor mounting plate.

12. The milling attachment of claim 5, wherein:
the frame includes a back plate configured to be mounted on the work machine.

13. The milling attachment of claim 1, wherein:
the first and second drive motors are hydraulic motors.

14. The milling attachment of claim 13, wherein:
the first and second hydraulic motors are completely received between the first frame side wall and the motor mounting plate.

15. The milling attachment of claim 1, wherein:
the frame includes a back plate configured to be mounted on the work machine.

16. The milling attachment of claim 1, wherein:
the central opening of the second drum mounting flange has a diameter equal to at least 40% of an inside diameter of a drum casing of the milling drum.

17. A milling attachment for a work machine, comprising:
a frame including first and second frame side walls;
a milling drum including first and second drum mounting flanges;
a motor mounting plate removably mounted on the second frame side wall;
a first drive motor mounted on the first frame side wall and including a drive end connected to the first drum mounting flange by a plurality of threaded fasteners; and
a second drive motor mounted on the motor mounting plate and connected to the second drum mounting flange by a stab-in non-threaded connector;
wherein the second drum mounting flange includes a central opening and a plurality of radially offset openings;
wherein the stab-in non-threaded connector includes a center hub mounted on the second drive motor and configured to be received in the central opening, and a plurality of radially offset pins configured to be received in the plurality of radially offset openings; and
wherein the stab-in non-threaded connector includes a base plate having a generally circular mid-portion with three protruding lobes, and the plurality of radially offset pins includes three radially offset pins one of which is mounted on each of the lobes.

18. A method of removing a milling drum from a milling attachment of a work machine, the milling attachment including:
a frame including first and second frame side walls;
a milling drum including first and second drum mounting flanges;
a first drive motor mounted on the first frame side wall and including a drive end connected to the first drum mounting flange by a first plurality of threaded fasteners;

a motor mounting plate removably mounted on the second frame side wall with a second plurality of threaded fasteners; and a second drive motor mounted on the motor mounting plate and connected to the second drum mounting flange by a stab-in non-threaded connector;

wherein the method comprises steps of:

(a) removing the motor mounting plate and the second drive motor by removing the second plurality of threaded fasteners to disconnect the motor mounting plate from the second frame side wall and withdrawing the stab-in non-threaded connector from the second drum mounting flange;

(b) disconnecting the first drive motor from the first drum mounting flange by removing the first plurality of threaded fasteners; and (c) removing the milling drum from the frame.

19. The method of claim 18, wherein:

the motors are hydraulic motors, and the method is performed without disconnecting any hydraulic hoses from the hydraulic motors.

* * * * *